US007800482B1

(12) United States Patent
Costin et al.

(10) Patent No.: US 7,800,482 B1
(45) Date of Patent: Sep. 21, 2010

(54) HIGH INTENSITY SMALL SIZE PERSONAL ALARM

(76) Inventors: Darryl J. Costin, 24586 Chapparal, Westlake, OH (US) 44145; Scott C. Harris, P.O. Box 1389, Rancho Santa Fe, CA (US) 92067; Clarence Martin, 290 E. Chester Ct., Gahanna, OH (US) 43220

( * ) Notice: Subject to any disclaimer, the term of this patent is extended or adjusted under 35 U.S.C. 154(b) by 347 days.

(21) Appl. No.: 11/782,780

(22) Filed: Jul. 25, 2007

Related U.S. Application Data

(60) Provisional application No. 60/820,304, filed on Jul. 25, 2006, provisional application No. 60/868,667, filed on Dec. 5, 2006.

(51) Int. Cl.
*G08B 23/00* (2006.01)

(52) U.S. Cl. ..... 340/321; 340/326; 340/333

(58) Field of Classification Search ..... 340/574, 340/573.1, 384.4, 384.6, 321, 326, 331, 332, 340/333, 576, 584.6; 320/116, 118, 119; 455/575.6; 362/240, 427
See application file for complete search history.

(56) References Cited

U.S. PATENT DOCUMENTS

| | | | | |
|---|---|---|---|---|
| 4,719,454 | A * | 1/1988 | Hopkins et al. | 340/574 |
| 5,512,881 | A * | 4/1996 | Majmudar | 340/574 |
| 5,585,749 | A * | 12/1996 | Pace et al. | 327/108 |
| 7,019,621 | B2 * | 3/2006 | Woodard et al. | 340/384.6 |
| 7,103,430 | B2 * | 9/2006 | Yamada | 700/94 |
| 7,173,525 | B2 * | 2/2007 | Albert | 340/521 |
| 7,245,226 | B1 * | 7/2007 | Thanhauser et al. | 340/660 |
| 7,269,452 | B2 * | 9/2007 | Cheung et al. | 455/575.6 |
| 7,489,106 | B1 * | 2/2009 | Tikhonov | 320/116 |
| 7,557,720 | B2 * | 7/2009 | Rubin et al. | 340/574 |
| 2005/0018435 | A1 * | 1/2005 | Selkee et al. | 362/427 |

* cited by examiner

*Primary Examiner*—Van T. Trieu
(74) *Attorney, Agent, or Firm*—Law Office of Scott C. Harris, Inc.

(57) ABSTRACT

A small but loud personal alarm system, which produces at least 135 KB of output noise from a small package which has no outer extends greater than 2¼".

13 Claims, 1 Drawing Sheet

HIGH INTENSITY SMALL SIZE PERSONAL ALARM

This application claims priority from provisional application 60/820,304 filed Jul. 25, 2006 and from provisional application 60/868,667 filed Dec. 5, 2006, the contents of which are herewith incorporated by reference.

BACKGROUND

Personal safety is a major concern. Streets of our cities are unsafe. Manufacturers have offered different devices to assist with crime deterrence.

Mace and/or pepper spray is one such attempt at deterrence. However, it is far from an adequate solution, since it can be turned against the owner with little effort. Even if not, many attackers, especially those with drug additions or mental illnesses, may be largely or completely oblivious to this kind of pain.

Another possibility is to carry a real weapon, such as a gun. As with the mace, the gun can be turned against the owner. Moreover, even a person properly defending themselves can be sued for injuring the attacking criminal.

A personal alarm can be activated when one feels danger. The rationale is that the attacker will flee when the personal alarm is activated.

SUMMARY

The present application teaches an improved personal alarm with both increased sound intensity and reduced size.

DETAILED DESCRIPTION

Figure 1:
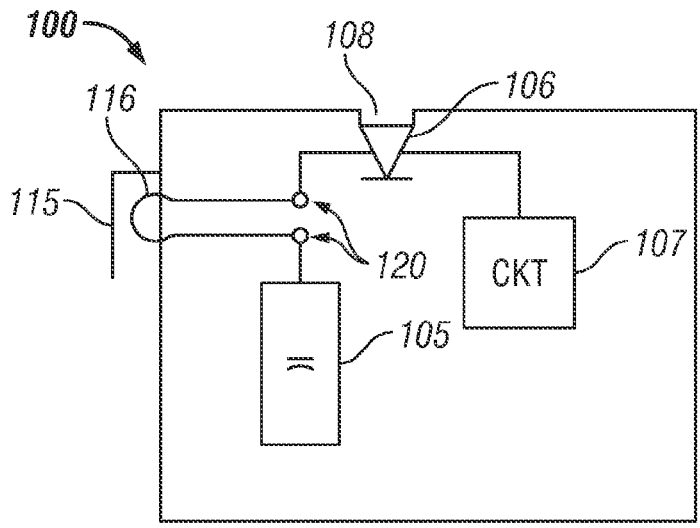
FIG. 1 shows a first embodiment using a 12 volt battery, piezoelectric crystal, circuit board and casing.

The inventors have secured a number of personal alarm devices that are available across the world, and measured the sound intensity and examined the size and configuration of the products. Surprisingly, there are only two distinct populations of personal alarms—those that are fairly large (with one dimension in excess of 2¾ inches) that produce sufficient sound intensity (at least 135 decibels), and those that are fairly small (less than 2 inches in one dimension) that produce insufficient sound intensity (less than 125 decibels). Sound is measured in a logarithmic scale such that a sound level of 135 decibels is twice as loud as a 125 decibels sound level. A 135 decibels sound level would be similar to the sound produced by a military jet taking off and considered to be quite adequate to drive away attackers and alert people in the immediate area of a need for help. All the personal alarms examined contain four principal components: a battery, a piezoelectric crystal which converts electrical energy to acoustical energy, a simple circuit board and a casing. Importantly, the inventors discovered that the battery choice limits both the size of the personal alarm unit and the sound intensity. The large personal alarms that produce 135 decibels sound levels are driven by a 9 volt battery. The size of the battery drives the size of these units to an excess of 2¾ inches in one dimension, and thus are relatively undesirable for practical carry purposes. Based upon a number of interviews, the inventors believe that a personal alarm will likely not be carried by a user if it is larger than 2¼ inches in its largest dimension. Preferably they should be even smaller. In this way, they could easily fit in women's small purses and men's pockets. However, the small personal alarms which are most desirable for carry purposes are driven by small 1.5 volt watch batteries and cannot produce the amperage to generate anywhere near the required sound levels of 135 decibels, and thus produce a sound of insufficient intensity to cause immediate alarm. Even the small devices which advertised 130 dB of sound, did not deliver that. Many such devices delivered 85-90 dB—much less than is needed for deterrence. The function of deterrence is not met—simply because the alarm is not loud enough.

Based on inventor tests, they believe that the alarm needs to emit at least 135 dB of sound intensity, more preferably 138 to 140 dB.

An embodiment disclosed herein obviates this problem by producing a very loud sound from a small sized device. This invention discloses a device that produces an excruciating sound intensity of 138 decibels (when measured 0.5 inches from the source of the sound), and is relatively small—less than 2.15 inches in the largest dimension and preferably less than 2 inches in the largest dimension. The authors tested numerous battery and battery configurations with existing crystals and circuits and discovered one unique battery, not found in any existing personal alarm, that surprisingly produced an extraordinarily loud sound of 138 decibels, yet allow for small casing sizes less than 2¼ inches in the largest dimension—a small 12 volt battery that is 1.1 inch long and less than 0.5 inch diameter. The actual 12 volt battery tested was a Duracell MN 21/23. Similar 12 volt batteries would also work. The device may use a single such battery or two batteries in a parallel configuration. In addition, the device can be made to produce a unique sound with a unique pitch or pattern that can be more easily recognized as a distress call. A first embodiment is shown in FIG. 1. In the embodiment, the housing 100 has an outer size that is less than 2¼ inches, and the housing is preferably approximately 2 inches by 1"×1 inches.

A drawback of previous systems is that the batteries simply did not produce a high enough voltage that is necessary to output a high sound. According to the present system, the battery shown as 105 is a specialized battery, such as the Duracell MN21/23 which is a 12 V battery The device also contains a piezoelectric crystal 106 which converts electrical energy to acoustical energy shown as 106, and a simple circuit board shown as 107. FIG. 1 illustrates an opening 108 in the housing, facilitating the noise production.

An alarm button 110 is covered with a safety latch 115, and has a button 116 under the safety latch. The button is preferably of a latching type, such that once activated, it remains activated until specifically deactivated. The button may simply short across two contacts shown as 120 which connects the battery 105 to the operative circuitry 106, 107.

Figure 2:
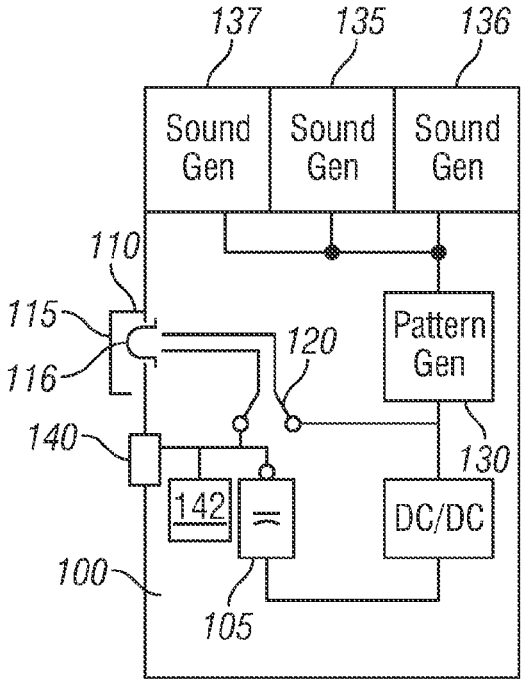
FIG. 2 shows a second embodiment using an electronic sound generator.

In a second embodiment shown in FIG. 2, a voltage increasing circuit, here a DC to DC converter 125 may double or more the voltage from the battery. An embodiment may use the V-Infinity VWRAS1-D12-D15-SIP, which takes a 9-12 volt input, and produces approximately 30 volt output, all in a very small package (about ¼ the size of the battery). An important feature noticed herein is that many DC to DC converters produce outputs which, while regulated, are still extremely choppy. It is conventional that such an output would be filtered by a capacitor, and the capacitor could take up extra space within the device. However, in this embodiment, the choppy output from the DC to DC converter will not cause any disadvantages. Therefore, according to one embodiment, the choppy output from the DC to DC converter is used directly without power filtering. Also, while the DC to DC converters run very hot and might typically need some kind of cooling, this embodiment uses the circuitry only very rarely. Therefore, when used, the DC to DC converter will conventionally be at ambient, it will heat up upon use, but will typically not be used for more than a few minutes. Therefore, it can be used without any kind of cooling.

All of the embodiments disclosed herein may additional structure and devices. A pattern generator 130, which produces a recognizable pattern may be used. The FIG. 1 embodiment may include this as part of the circuit card 107. If an electronic circuit is used for the pattern generator, a dual voltage DC to DC converter can be used so that only half the output voltage can drive the generator. Alternatively, the pattern generator 130 can be driven directly from the battery.

One such pattern can simply be the unique signal for the SOS (short, short, short, long, long, long, short, short, short). Sounds associated with foghorns, sirens, and emergency vehicles can also be produced by the pattern generator. A siren sound may be particularly preferred.

The output of the pattern generator drives one or an array of electronic sound generators 135. The electronic sound generators 135 can be piezoelectric sound generators. For example, the sound generators used for telephone ringers can be used. Multiple generators 136, 137 may also be used, to enhance the non-directionality of the sound, that is to eject the sound in multiple different directions, and also to increase the sound output level.

The embodiment requires at least 135 dB of volume, more preferably 138 dB, and even more preferably 140 dB.

In operation, when the switch 116 is actuated, it applies power to the DC to DC converter, which within a few milliseconds produces an output voltage of 24 to 30 V on line 126. This is applied to the pattern generator, which produces a recognizable sound and drives the electronic sound generator 135 at a very high voltage to produce a high volume output sound.

Another important feature of this system is to maintain the battery life. A system must be capable of working in emergencies, and hopefully is not used often, even more hopefully is not used ever. Therefore in this embodiment, the battery is totally isolated from the circuitry unless and until the button 116 is pressed. This prevents the battery from discharging into the circuitry. However, a test button 140 allows imposing contacts across the battery, and producing an indication of the battery life. The test button 140 can include for example a circuit 142 that determines if the battery voltage is above a specified level or not. The test circuit can include for example is a zener diode, that produces output only if the voltage is above the avalanche voltage of the diode. If the battery is above the specified level, a bicolor LED may be driven into its green state, while a battery below the specified level produces either a red state or no LED state at all.

Figure 3:
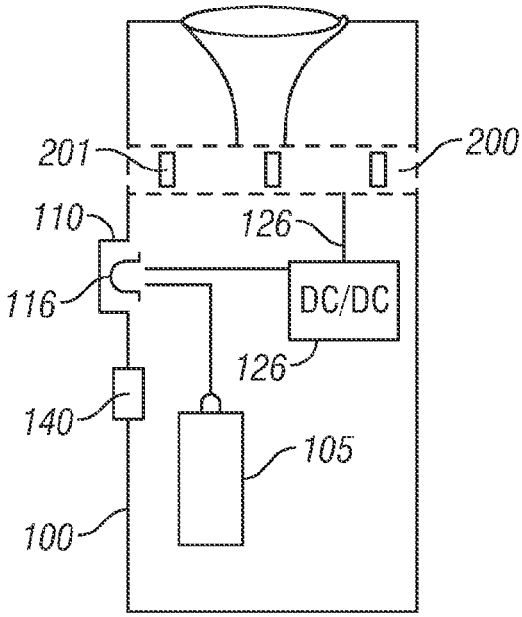
FIG. 3 shows using an air based generator.

FIG. 3 shows an alternative embodiment, having similar button 116, cover 110, housing 100, battery 105, and DC to DC converter 125 and tester 140. However, in this embodiment, the voltage output 126 drives a high speed fan 200 which forces air into a very narrow orifice 220. The orifice is tuned according to the airflow to produce a very loud foghorn style noise or whistle. The fan also includes a number of air intakes 201 which allows sucking the air into the orifice. The input air may also cool the DC to DC converter.

The general structure and techniques, and more specific embodiments which can be used to effect different ways of carrying out the more general goals are described herein. Although only a few embodiments have been disclosed in detail above, other embodiments are possible and the inventor (s) intend these to be encompassed within this specification. The specification describes specific examples to accomplish a more general goal that may be accomplished in another way. This disclosure is intended to be exemplary, and the claims are intended to cover any modification or alternative which might be predictable to a person having ordinary skill in the art. For example, other circuits and sound equipment can be used.

Also, the inventor(s) intend that only those claims which use the words "means for" are intended to be interpreted under 35 USC 112, sixth paragraph. Moreover, no limitations from the specification are intended to be read into any claims, unless those limitations are expressly included in the claims.

Where a specific numerical value is mentioned herein, it should be considered that the value may be increased or decreased by 20%, while still staying within the teachings of the present application, unless some different range is specifically mentioned.

The invention claimed is:

1. A personal alarm system, comprising:

a housing, having no outer dimension larger than 2¼ inches, and defining an inner cavity;

a connection for a 12 volt battery, inside said inner cavity;

an electronic circuit board inside said inner cavity;

an electronic sound generator inside inner cavity, receiving an output voltage from said battery and producing a sound based thereon, wherein said sound is at least 135 dB; and a switch, extending to an outside of said housing, operating when actuated to produce the sound.

2. A system as in claim 1 wherein no outer dimension is no larger than 2 inches and said sound is greater than 138 db.

3. A system as in claim 1, further comprising a pattern generator electronic circuit, which produces a pattern that is played by said sound generator.

4. A system as in claim 3, wherein said pattern is an SOS pattern.

5. A system as in claim 3, wherein said pattern is a siren type pattern.

6. A system as in claim 1, wherein said battery is wholly isolated from all circuits in the system when not in use.

7. A system as in claim 1, wherein said switch electrically disconnects said battery from all circuits in the system when deactuated.

8. A system as in claim 1, further comprising a battery tester part, connectable across said battery to test a voltage thereof.

9. A system as in claim 1, further comprising a voltage increasing part, receiving voltage from the battery, and increasing a voltage of the battery.

10. A personal alarm system, comprising:

a housing, having no outer dimension larger than 2¼", and defining an inner cavity;

a connection for a battery, inside said inner cavity;

a voltage increasing circuit that increases a voltage of an output of said battery, coupled to said battery connection, inside said inner cavity;

an electronic sound generator, receiving an output voltage from said voltage increasing circuit, and producing a sound based thereon, wherein said sound is at least 135 dB; and a switch, extending to an outside of said housing, operating when actuated to connect an output of said voltage circuit to said electronic sound generator.

11. A system as in claim 10, wherein said voltage increasing circuit is a DC to DC converter whose output is used without filtering or capacitors between said DC to DC converter and said electronic sound generator.

12. A personal alarm system, comprising:

a housing having an outer surface and an inner surface, and having outer dimensions, no outer dimension of which is greater than 2¼";

said outer surface including a switch thereon, which can be actuated by a user;

a battery connection, coupled to said switch, said battery connection being coupled to said inner surface, and including a connection for a battery;

an electronic pattern generator, which produces a pattern of first sounds and second sounds in a repeated fashion, powered by said battery wherein said switch is actuated; and an electronic sound generator, powered by said battery when said switch is actuated, said electronic sound generator producing at least 135 dB of sound when actuated.

13. A device as in claim 12, further comprising a circuit that increases an output voltage of said battery, connected to said battery by actuation of said switch, wherein said increased output voltage is connected to said electronic sound generator.

* * * * *